US005875598A

United States Patent [19]

Batten et al.

[11] Patent Number: 5,875,598

[45] Date of Patent: Mar. 2, 1999

[54] FIRE BLANKET

[75] Inventors: Robert Batten; C. Michael Schuerman, both of Gwinnett County, Ga.

[73] Assignee: MM Systems Corporation, Tucker, Ga.

[21] Appl. No.: 818,623

[22] Filed: Mar. 14, 1997

[51] Int. Cl.[6] ..... E04B 1/68

[52] U.S. Cl. ..... 52/396.01; 52/396.03; 52/573.1

[58] Field of Search ..... 52/396.03, 396.01, 52/573.1

[56] References Cited

U.S. PATENT DOCUMENTS 4,517,779 5/1985 Dunsworth .
4,999,962 3/1991 Gohlke et al. ..... 52/396.07
5,269,110 12/1993 Morrison et al. ..... 52/396.01 X
5,365,713 11/1994 Nicholas et al. ..... 52/396.03 X

*Primary Examiner*—Christopher Kent
*Attorney, Agent, or Firm*—Snell & Wilmer L.L.P.

[57] ABSTRACT

A fire blanket for use in an expansion or seismic joint cover system. The cover includes a first layer made of flame retardant material, a second layer made of thermal resistant material, and a third layer made of an insulating material. A fourth layer may be placed over the third layer if desired and would also be made of a flame retardant material. The first, second, and if used, fourth layers includes folded over portions to form pleats. The pleats within each layer are offset relative to pleats within the other layers. During lateral movement of the sections of structure forming the expansion or seismic joint, the pleats allow the fire blanket to expand longitudinally without tearing.

22 Claims, 5 Drawing Sheets

FIRE BLANKET

TECHNICAL FIELD

The present invention relates, generally, to covers for joints of structures such as buildings, bridges, and the like, and more particularly to covers for expansion or seismic joints of such structures, whereby the cover provides a barrier against a variety of material compositions.

BACKGROUND OF THE INVENTION

Structures such as buildings and bridges comprise various sections to make up the floors, walls, support beams, the roadway, and the like. These various sections are sometimes spaced apart from each other to form gaps that are referred to as expansion joints or simply joints. These joints can be either expansion joints, i.e. voids designed to accommodate expansion and contraction typically caused by temperature change, or seismic joints, which are voids designed to accommodate expansion and contraction due to earthquakes.

Building codes require fire protection for buildings and accordingly, these joints must provide fire protection to prevent fire from spreading from floor to floor or room to room. Typically the joints will be covered with a plate that serves as a cover to allow normal passage over the joint. A fire blanket hangs under the plate between the two sections that form the joint and within the joint. Generally, the fire blanket will comprise a first layer that hangs lowest within the joint and is typically made of a flame retardant material such as zetex, zseal or zelex HT. A second layer will lie on top of the first layer and is generally made of a thermal resistant material, such as Refrasil®, The Carborundum Company, Fibers Division, P.O. Box 808, Niagara Falls, N.Y. 14302-0808, that impedes heat flow. A third layer is used as an insulator and typically is made of a fabric such as kaowool. A fourth layer is often used on top of the third layer, or what is termed the "cold side," and is generally made of zetex. All four layers are generally stapled together to form the fire blanket. However, the middle two layers do not extend outward as far as the first and fourth layers. These outer portions are generally referred to as "ears" and are approximately two inches in width. The blanket is stapled together at the ear and the ears are used to mount the blanket to the two adjoining sections, such as abutting sections of a floor, that form the joint. The blanket is generally attached to the abutting sections with nails and L-shaped brackets that run lengthwise along the sections. The fire blanket is mounted within the joint in such a manner that it literally hangs down into the joint in a U-shape and thus provides more width within the blanket than is necessary to cover the joint.

Problems occur when the abutting sections move relative to each other due to sway within the structure that contains them, i.e. sway of the building due to an earthquake, or expansion of the sections due to temperature. When the sections move vertically with respect to each other, or, horizontally toward or away from each other, there generally is no problem with respect to the fire blanket due to the fact that the blanket is wider than necessary to cover the joint. However, when the sections shear with respect to each other (for example when the pieces move horizontally but laterally with respect to each other), the force can tear the blanket thus compromising effectiveness of the joint cover against the spread of fire.

An attempt to protect against damage to the fire blanket due to lateral shear utilizes a sliding rail-type system. This system is called "3-D Movement" and is described and illustrated in the catalog of Balco/Metalines, 2626 South Sheridan, Wichita, Kans. It involves utilizing a bracket to attach a vertical section of a fire blanket to one corner of, for example, an abutting floor section that with a second abutting floor section forms a joint. The bracket runs continuously lengthwise along the section and has a continuous, laterally extending, upturned "hook" portion covering a top portion of the fire blanket. A second section of fire blanket is attached to a parallel and opposing corner of the second floor with an L-shaped bracket. This second portion of fire blanket then has a continuous, laterally extending, down-turned "hook" attached to it opposite the L-shaped bracket. This down-turned "hook" is placed within the aforementioned upturned "hook" to form a seal and connect the two sections of fire blanket. The seal runs continuously along and just below the parallel corners of the oppositely disposed floor sections. The "hooks" can slide laterally with respect to one another thereby accommodating the lateral shear of the two abutting floor sections. This system, however, greatly increases the cost of the joint cover because of the extra cost associated with the hook portions, as well as the extra labor involved. Additionally, the seal may breach from the weight of the second portion of fire blanket which can move due to thermal currents during a fire.

An expansion joint cover is therefore needed which overcomes the shortcomings of the prior art.

SUMMARY OF THE INVENTION

A joint cover comprising a fire blanket according to the present invention addresses the shortcomings of the prior art. The fire blanket can be made to provide a barrier to other elements such as water, air, smoke, gas or numerous other material compositions. The individual layers would merely be required to be made of appropriate materials.

In accordance with one aspect of the present invention, an expansion joint cover comprises a first layer that includes at least one folded-over portion to form a pleat. When mounted within a joint formed by two abutting pieces of, for example, a floor, the pleat allows the joint cover to expand laterally without tearing.

In accordance with a further aspect of the present invention, one or more inner layers are sandwiched between two outer layers to form a fire blanket. The outer layers are typically made of a flame retardant material, while the inner layers are typically made of materials to provide a thermal resistance layer to inhibit heat flow and/or a layer to act as an insulator. Generally, only the flame retardant and thermal resistant layers are pleated.

In accordance with a further aspect of the present invention, the pleats of the various layers are staggered with respect to the other layers.

BRIEF DESCRIPTION OF THE DRAWING FIGURES

The present invention will hereinafter be described in conjunction with the appended drawing figures, wherein like designations denote like elements, and:

DETAILED DESCRIPTION OF PREFERRED EXEMPLARY EMBODIMENTS

Figure 1:
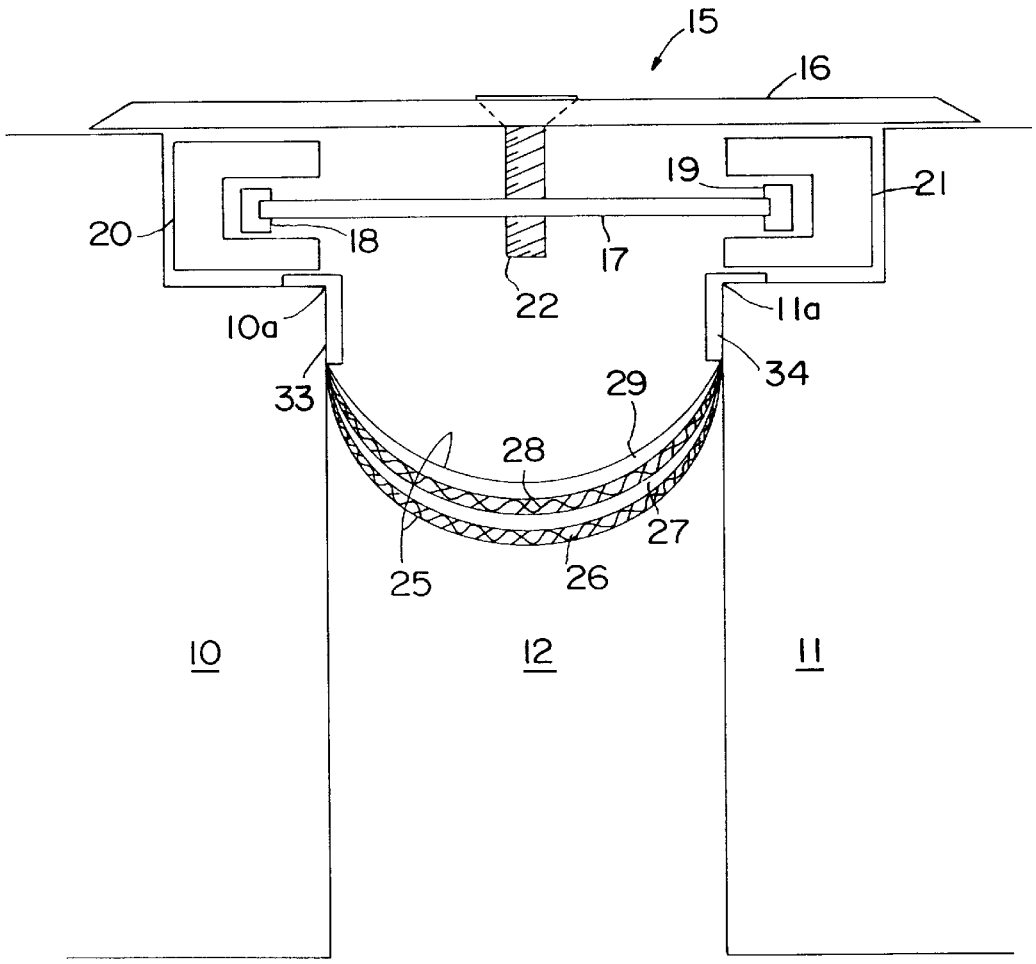
FIG. 1 is a cross-sectional view of a joint cover system made in accordance with the preferred embodiment of this invention.
Figure 2:
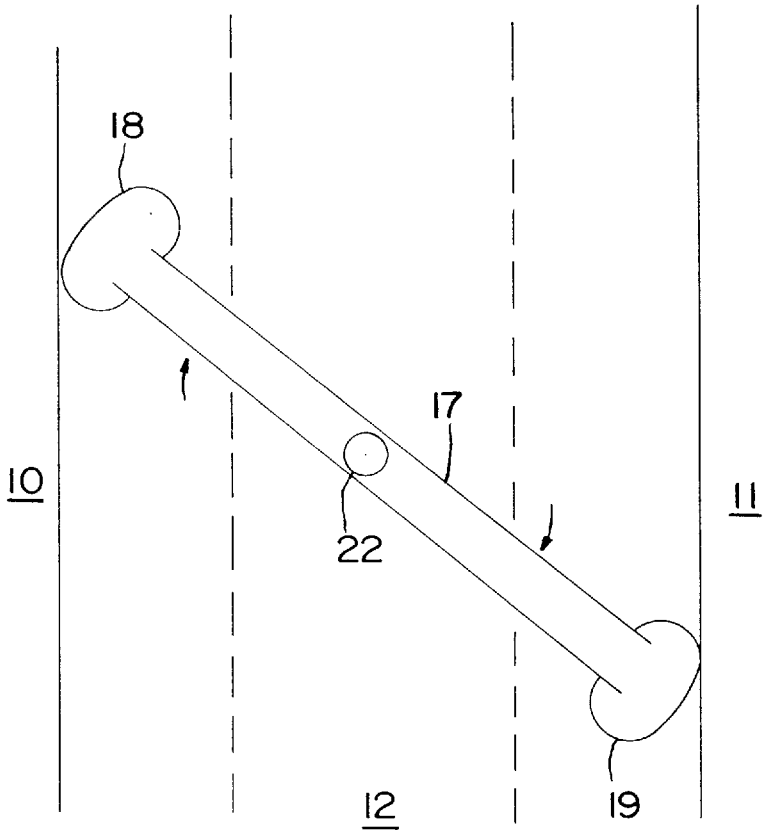
FIG. 2 is a plan view of a joint cover system illustrated in FIG. 1.

FIG. 1 illustrates abutting sections 10 and 11 that form a joint 12. Each section 10, 11 has a corresponding corner 10*a*, 11*a*. These sections are, for example, concrete sections of a floor within a building. Since there are generally multiple floors within a building, it is desired to prevent a fire on a lower floor from spreading through the joint 12 to an upper floor. Accordingly, a joint cover 15 is mounted between the two sections, 10, 11 and runs continuously laterally. The joint cover 15 generally comprises a top plate 16. A centering bar 17 is used to maintain the plate 16 in a centered position over the joint 12. Ends 18, 19 of the centering bar 17 are contained within aluminum portions 20, 21. A centering pin 22 secures the plate 16 to the centering bar 17. If sections 10, 11 move toward each other, the centering bar pivots as illustrated in FIG. 2, while maintaining the centering pin 22, and thereby the top plate 16, in a centered position with respect to the joint 12.

The joint cover 15 further comprises a fire blanket 25. The fire blanket can be made to provide a barrier to other elements such as water, air, smoke, gas or numerous other material compositions. The individual layers would merely be required to be made of appropriate materials. The fire blanket, in the preferred embodiment, comprises a first or outer layer 26 that is generally made of a flame retardant material such as zetex. A first inner layer 27 is placed over the first outer layer 26 and is generally made of a thermal resistant material such as Refrasil®. The fire blanket 25 further comprises a second inner layer 28 that is placed over the first inner layer 27 and generally acts as an insulator. The second inner layer is typically made of a material such as kaowool. A second outer layer 29 is typically placed over the second inner layer 28. This second outer layer is generally made of the same flame retardant material as the first outer layer 26. Because in the present example the sections 10, 11 are abutting portions of a floor, it is desired to prevent fire from spreading from a lower floor to an upper floor. The second outer layer therefore is considered to be on the "cold side" and is not necessary if it is desirable to omit it.

The fire blanket 25 is attached to the sections 10, 11 with L-shaped brackets 33, 34 and nails 46 that secure end portions 35, 36 of the blanket to the sections 10, 11. These end portions are typically referred to as "ears." The brackets 33, 34 secure the blanket 25 tightly to the corners 10*a*, 11*a*. The nails 46 are spaced apart along the length of the brackets 33, 34 and extend through holes 37 in the brackets to form a bracket/blanket assembly 32 and also to secure the bracket/blanket assembly 32 to each opposing corner 10*a*, 11*a*. In an alternative embodiment, any means for securing fire blanket 25 to sections 10, 11 can be used including, inter alia, screws or glue.

Figure 5:
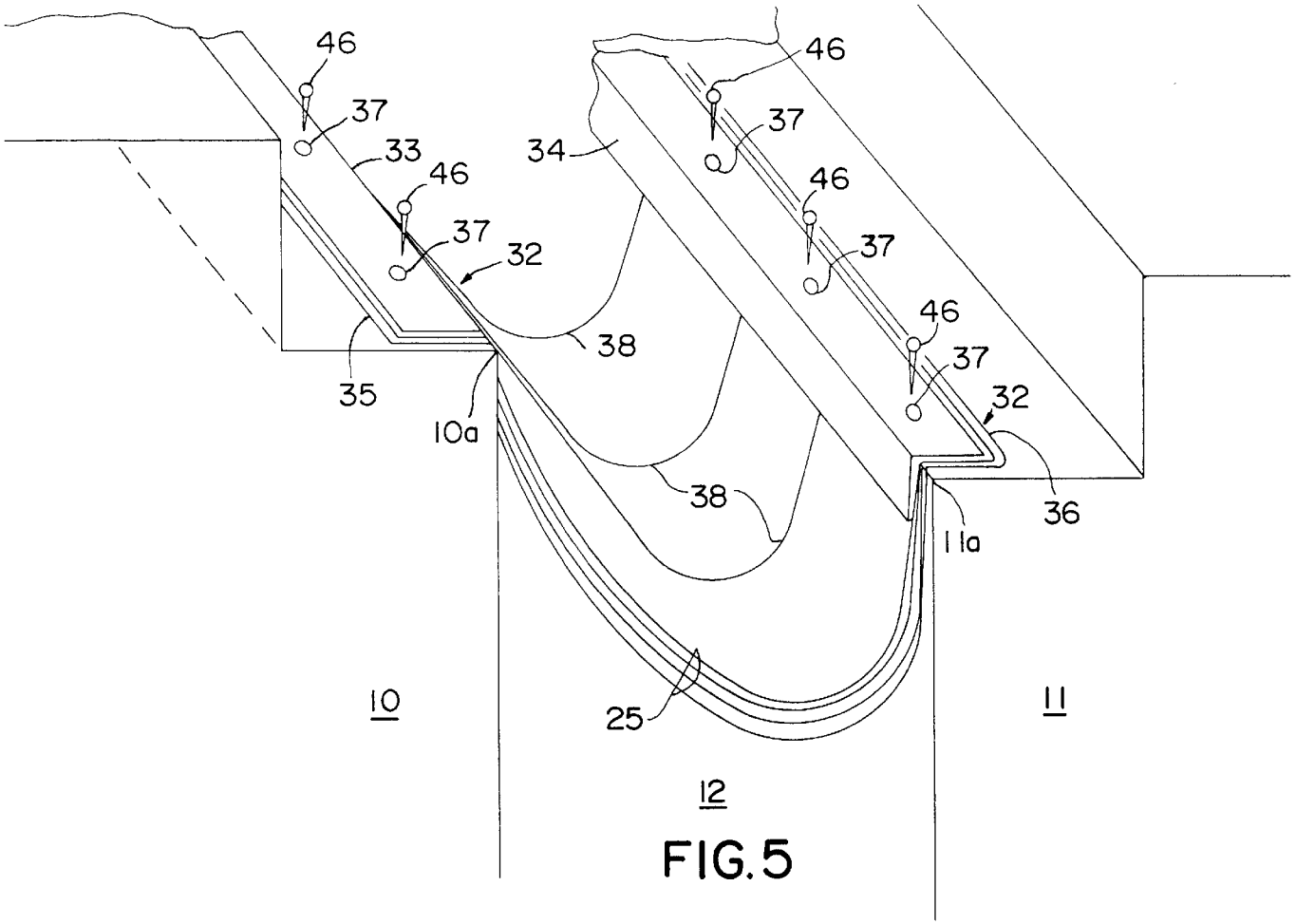
FIG. 5 is a perspective view of a joint cover system made in accordance with the present invention but with some elements removed for clarity.

The brackets 33, 34 run longitudinally along the sections 10, 11 and secure the fire blanket 25 in such a manner as to allow the fire blanket to hang within the joint 12 in a U-shape as can be seen in FIGS. 5 and 6. The fire blanket 25 is therefore wider than necessary to cover the joint 12. This allows for the fire blanket to move without tearing due to relative vertical movement of the sections 10, 11 with respect to each other and additionally to allow for horizontal movement towards and away from each other.

Figure 3:
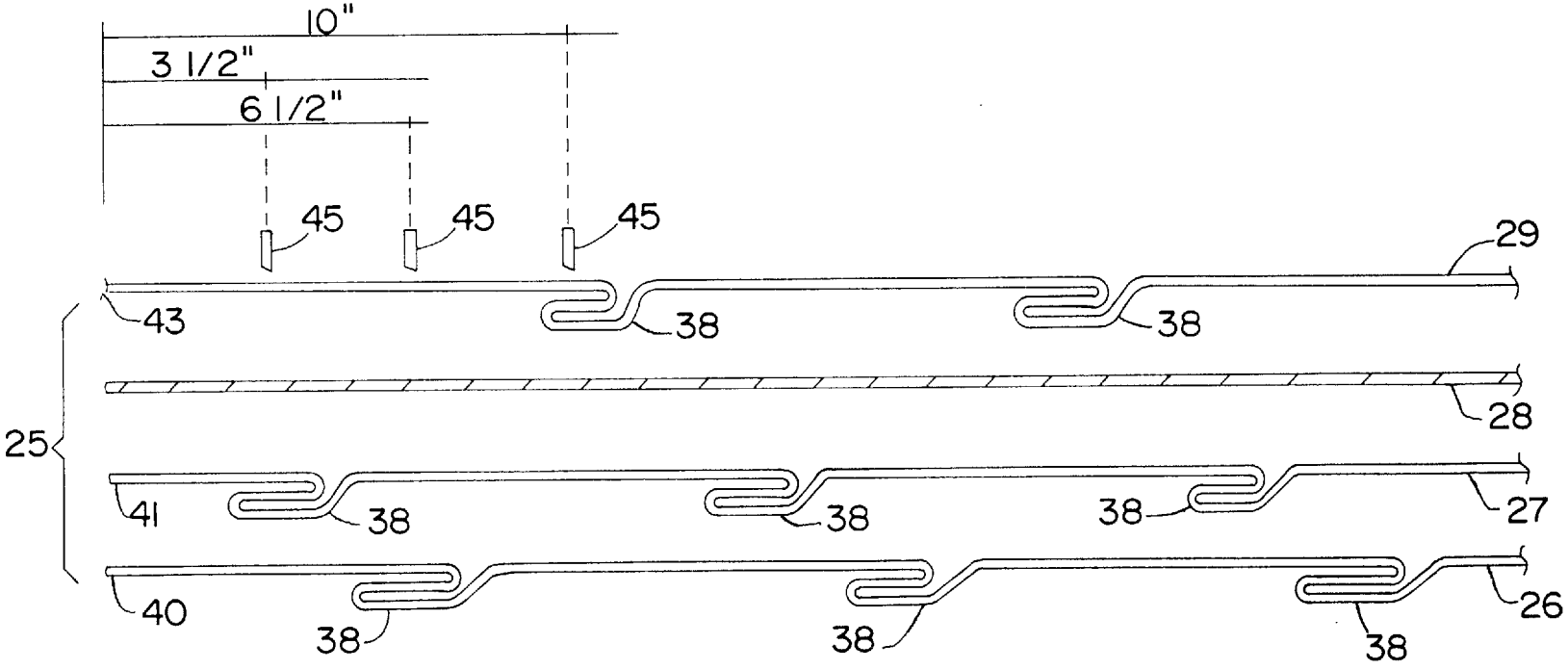
FIG. 3 is a perspective view of a fire blanket in accordance with the preferred embodiment of this invention.
Figure 4:
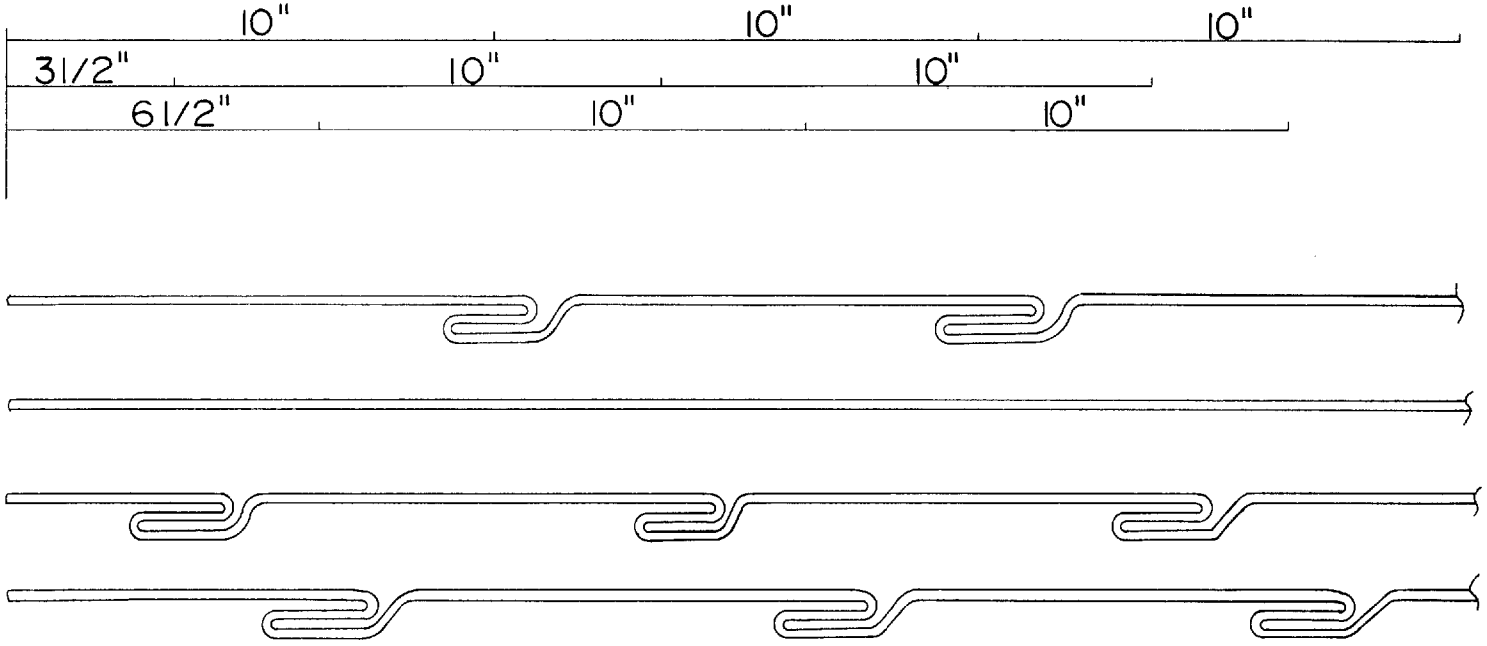
FIG. 4 is a cross-sectional, exploded view of the fire blanket illustrated in FIG. 3.

As illustrated in FIGS. 3 and 4, the fire blanket 25 is constructed such that the first outer layer 26, first inner layer 27, and second outer layer 29 have portions that are folded over each other to form pleats 38. The various layers are secured together with staples 45 that are spaced 0.5 to 5 inches apart. In the preferred embodiment, the staples are spaced 2 inches apart. The pleats 38 of each layer are preferably staggered with respect to each other. As illustrated in FIG. 4, the first outer layer 26 preferably has its first pleats 6½ inches from an end 40 with each successive pleat occurring every 10 inches thereafter. The first inner layer 27 preferably has its first pleat 3½ inches from an end 41 and each successive pleat 10 inches thereafter. The second inner layer 28 generally is not pleated but can be if it is so desired. The second outer layer 29 preferably has its first pleat 10 inches from an end 43 with each successive pleat spaced 10 inches thereafter. Of course these spacings can be varied to suit different needs and different shearing conditions.

Each layer varies in width to allow for the blanket 25 to hang within the joint 12 in the desired U-shape. Accordingly, the first outer layer 26 is the widest. The second outer layer 29 is the second widest. This allows for the formation of the ears 35, 36, which may or may not include the middle layers.

Each pleat is preferably 2 inches in length. Accordingly, each pleat 38, because of its folded over format, provides an extra 4 inches in material if the pleat were to be expanded or, pulled out, longitudinally. The pleat length is related to the width of the fire blanket and the hypotenuse of a triangle. The smaller the hypotenuse is, the shorter the pleat length is. The equation relating the pleat length, width of the fire blanket and hypotenuse is given by: $Hyp=((\text{Pleat } L)^2+(\text{Blanket } W)^2)^{1/2}$.

As can readily be seen, if the sections 10, 11 move laterally with respect to each other, as illustrated in FIG. 5 with the arrows, pleats 38 and the longitudinal length of the fire blanket 25 will expand, thereby inhibiting tearing of the blanket 25. Additionally, installation with the L-shaped brackets 33, 34 provides a means for securing the blanket that is economical without the potential for compromising the seal provided by the blanket during lateral movement of the sections 10, 11.

It will be understood that the foregoing description is of the preferred exemplary embodiment of the invention, and that the invention is not limited to the specific forms shown. Various modifications may be made in the design and arrangement of the elements set forth herein without departing from the scope of the invention as expressed in the appended claims.

We claim:

1. A blanket for preventing the passage of a material composition, said blanket comprising a layer that includes at least one folded portion to form a pleat, said pleat configured to provide enhanced shear displacement.

2. The blanket of claim 1 wherein said material composition includes at least one of fire, water, air, smoke and gas.

3. The blanket of claim 1 wherein said layer includes multiple folded portions to form multiple pleats.

4. The blanket of claim 1 wherein said layer of said blanket comprises first and second layers, wherein said second layers include at least one folded portion to form a pleat.

5. The blanket of claim 4 wherein said second layers include multiple folded portions to form multiple pleats.

6. The blanket of claim 5 wherein the pleats of said second layers are staggered with respect to the pleats of other said second layers.

7. The blanket of claim 6 wherein at least one of said first and second layers of the blanket comprises a flame retardant material.

8. The blanket of claim 7 wherein at least one of said first and second layers of said blanket comprises a thermal resistant material.

9. The blanket of claim 8 wherein each pleat is 2 inches in length.

10. The blanket of claim 9 wherein said blanket includes outer and inner layers, wherein a first outer layer has a first pleat 6½ inches from an end and each successive pleat is located every 10 inches thereafter, and a first inner layer has a first pleat 3½ inches from an end and each successive pleat is located every 10 inches thereafter, and a second outer layer has a first pleat 10 inches from an end and each successive pleat is located every 10 inches thereafter.

11. A joint blanket system for covering a gap joint between two abutting structures comprising:

a means for accommodating relative movement of the two structures with respect to each other;

a blanket including at least one folded portion to form a pleat, said pleat providing enhanced shear displacement; and means for securing said blanket between the two structures.

12. The joint blanket system of claim 11 wherein said blanket prevents passage of at least one of fire, air, water, smoke, and gas.

13. The joint blanket system of claim 11 wherein said blanket comprises first and second layers, wherein said second layers include at least one folded portion to form a pleat.

14. The joint blanket system of claim 13 wherein at least one of said second layers of said blanket has multiple folded portions to form multiple pleats.

15. The joint blanket system of claim 11 wherein said layers of said blanket comprise first and second layers wherein said second layers include at least one folded portion to form a pleat.

16. The joint blanket system of claim 15 wherein said second layers of said blanket have multiple folded portions to form multiple pleats.

17. The joint blanket system of claim 16 wherein said pleats of said second layers are staggered with respect to the pleats of other said second layers.

18. The joint blanket system of claim 17 wherein at least one of said first and second layers of said blanket is made of a flame retardant material.

19. The blanket of claim 18 wherein at least one of said first and second layers of said blanket is made of a thermal resistant material.

20. The joint blanket system of claim 19 wherein each pleat is 2 inches in length.

21. The joint blanket system of claim 20 wherein said blanket includes outer and inner layers, wherein a first outer layer of said blanket has a first pleat 6½ inches from an end and each successive pleat is located every 10 inches thereafter, and a first inner layer of said blanket has a first pleat 3½ inches from an end and each successive pleat is located every 10 inches thereafter, and a second outer layer of said blanket has a first pleat 10 inches from an end and each successive pleat is located every 10 inches thereafter.

22. The joint blanket system of claim 21 wherein said blanket has a second inner layer that is not pleated.

* * * * *